US005865438A

United States Patent [19]

Zilliox

[11] Patent Number: 5,865,438

[45] Date of Patent: Feb. 2, 1999

[54] COMBINED WATER PISTOL AND TARGET FOR WATER CATCH GAME

[76] Inventor: Kent Zilliox, 361 Halsey Ave., San Jose, Calif. 95128

[21] Appl. No.: 353,150

[22] Filed: Dec. 9, 1994

Related U.S. Application Data

[63] Continuation of Ser. No. 121,242, Sep. 14, 1993, abandoned, which is a continuation-in-part of Ser. No. 86,056, Jun. 30, 1993, Pat. No. 5,435,569.

[51] Int. Cl.[6] ..... A63B 67/00

[52] U.S. Cl. ..... 273/349; 222/79

[58] Field of Search ..... 273/349; 446/225, 446/176, 473; 141/18; 222/79

[56] References Cited

U.S. PATENT DOCUMENTS

| | | | |
|---|---|---|---|
| 3,336,030 | 8/1967 | Martell et al. | 273/349 |
| 3,365,838 | 1/1968 | Butler | 222/79 |
| 3,434,717 | 3/1969 | Schwartz | 273/349 |
| 3,438,547 | 4/1969 | Perelda et al. | 222/79 |
| 3,477,723 | 11/1969 | Peidda | 273/349 |
| 4,040,622 | 8/1977 | Sinnott | 273/349 |

*Primary Examiner*—Mark S. Graham
*Attorney, Agent, or Firm*—James J. Leary; Carol D. Titus

[57] ABSTRACT

A water pistol which has a water-collecting target mounted on it. The water pistol has a water firing mechanism that squirts a stream of water from the pistol. The water-collecting target is connected to the water firing mechanism of the water pistol so that water which strikes the target is collected and can be squirted again by the firing mechanism. The water pistol may also have a water reservoir connected between the water-collecting target and the water firing mechanism that can collect a supply of water sufficient for multiple squirts. Different water collecting targets and water firing mechanisms suitable for the invention are described. When the special water pistols are used in pairs, they can be used for a game of water catch where one player squirts a stream of water toward a second player, and the second player tries to catch the water in the water-collecting target of his or her water pistol and squirt it back to the first player. A number of variations of the water catch game are described.

24 Claims, 5 Drawing Sheets

COMBINED WATER PISTOL AND TARGET FOR WATER CATCH GAME

RELATIONSHIP TO OTHER APPLICATIONS

This patent application is a continuation of Ser. No. 08/121,242, filed Sep. 14, 1993, now abandoned, which is a continuation-in-part of the patent application of Kent Zilliox, Ser. No. 08/086,056, Jun. 30, 1991, U.S. Pat. No. 5,435,569 for a Combined Water Pistol and Scoring Target, the specification of which is hereby incorporated by reference in its entirety.

FIELD OF THE INVENTION

The present invention relates to toys and amusement devices. More particularly, it relates to a squirt gun or water pistol which is combined with a water-catching target for playing a water catch game.

BACKGROUND OF THE INVENTION

Squirt guns and water pistols are perennially popular toys for children and, more and more, for adults as well. Recent improvements in the area of squirt guns have caused an upsurge in their popularity as toys. These improvements include the introduction of high volume water pistols with high capacity water tanks. One popular version of the high volume water pistol is the "Super Soaker" from Larami Corp. which pumps out high velocity streams of water. Another recent improvement in the sophistication of water pistols, which is described in U.S. Pat. No. 4,492,318, is a water pistol where the stream of water can be directed anywhere in 360 degrees.

Water pistols can be used for target shooting and for playing simulated combat games where a number of players try to shoot one another with their water pistols. Such simulated combat games are not appropriate for all players, especially for young children. Some parents disapprove of toy guns and simulated combat games for their children because of their symbolic association with real war and violence. For others, these combat games are too competitive and do not foster cooperation between players. For these people a gentler and less competitive game is preferred which will instill values of teamwork and cooperation. At the same time, it is important to make the game fun and exciting for adults and children to play.

SUMMARY OF THE INVENTION

In keeping with the foregoing discussion, one objective of the present invention is to provide a game that has the fun and excitement of currently popular water games. A second objective is to provide a nonviolent and cooperative water game that encourages teamwork among players. Another objective is to provide a water game that is appropriate for young children, as well as older children and adults.

In accordance with these objectives, the present invention takes the form of a water pistol which has a water collecting target mounted on it. The water pistol has a water firing mechanism that squirts a stream of water from the pistol. The water collecting target is connected to the water firing mechanism of the water pistol so that water which strikes the target is collected and can be squirted again by the firing mechanism. The water pistol may also have a water reservoir connected between the water collecting target and the water firing mechanism that can collect a supply of water sufficient for multiple squirts. Different water collecting targets and water firing mechanisms suitable for the invention are described.

When the special water pistols are used in pairs, they can be used for a game of water catch where one player squirts a stream of water toward a second player, and the second player tries to catch the water in the water collecting target of his or her water pistol and squirt it back to the first player. A number of variations of the water catch game are described. Other objects and advantages of the invention will no doubt occur to those skilled in the art upon reading and understanding the following detailed description along with the accompanying drawings.

DETAILED DESCRIPTION OF THE INVENTION

Figure 1:
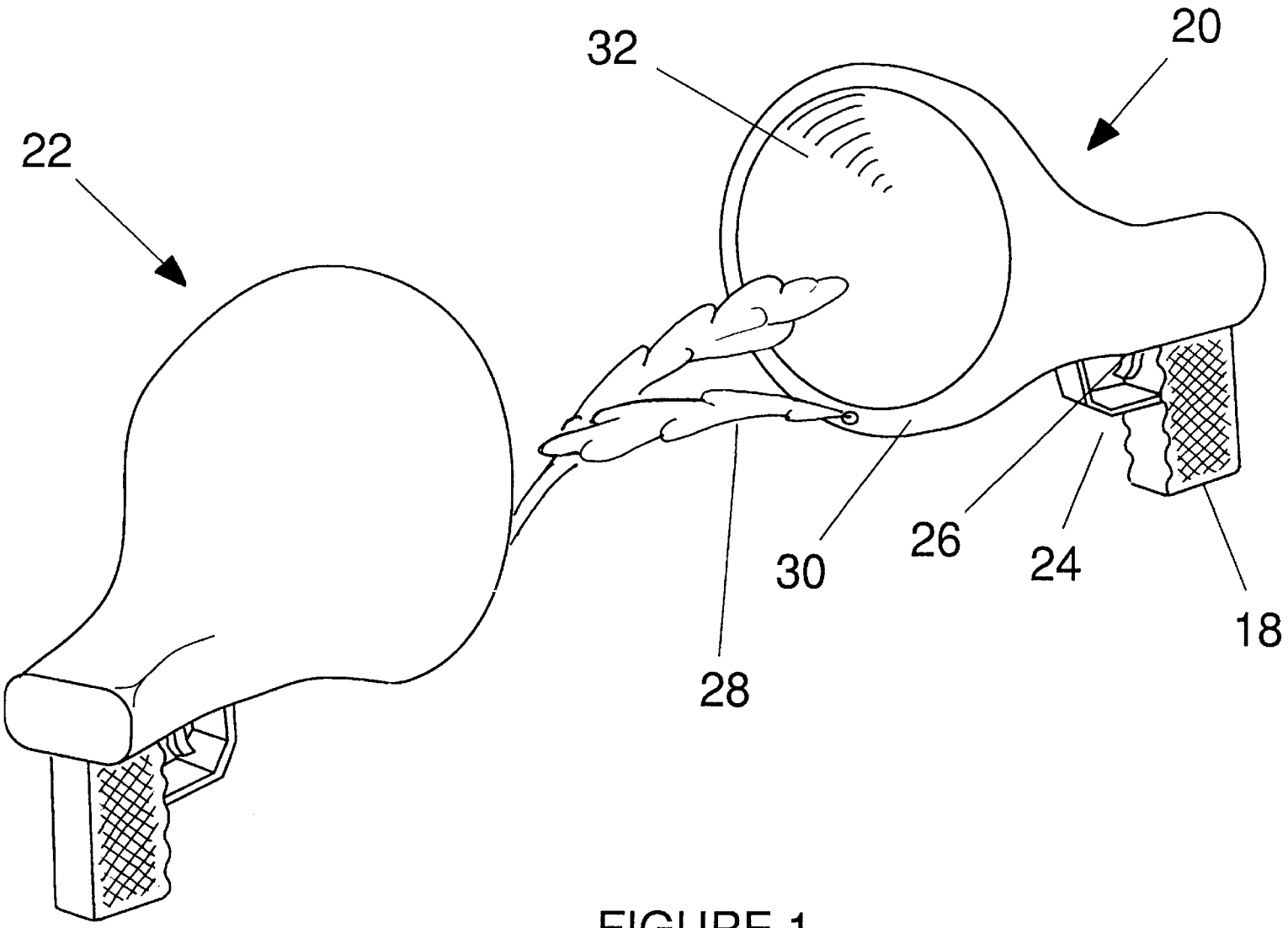
FIG. 1 shows a first embodiment of the water catch game with a trigger-activated water firing mechanism.

FIG. 1 shows a pair of water pistols 20 and 22 for playing the water catch game. In this embodiment, each water pistol has a trigger-activated water firing mechanism 24. Each time the trigger 26 of the firing mechanism is depressed, the water pistol emits a stream of water 28 from the pistol barrel 30. The firing mechanism 24 can be a standard piston-type water pump operated by manually depressing the trigger 26 of the water pistol. Alternatively, the firing mechanism can include an electric pump or a pressurized fluid source that is activated by a switch or valve operated by depressing the trigger 26. A squeeze-bulb type of water pump can be also be used in place of the trigger activated firing mechanism. Each water pistol also includes a large scoop-shaped target 32, which is molded integrally with the barrel 30 of the water pistol. The scoop-shaped target 32 is connected to the firing mechanism 24 of the is pistol, either directly or by way of a fluid reservoir 18, so that water gathered by the target 32 is available to be squirted out by the firing mechanism 24.

Figure 2:
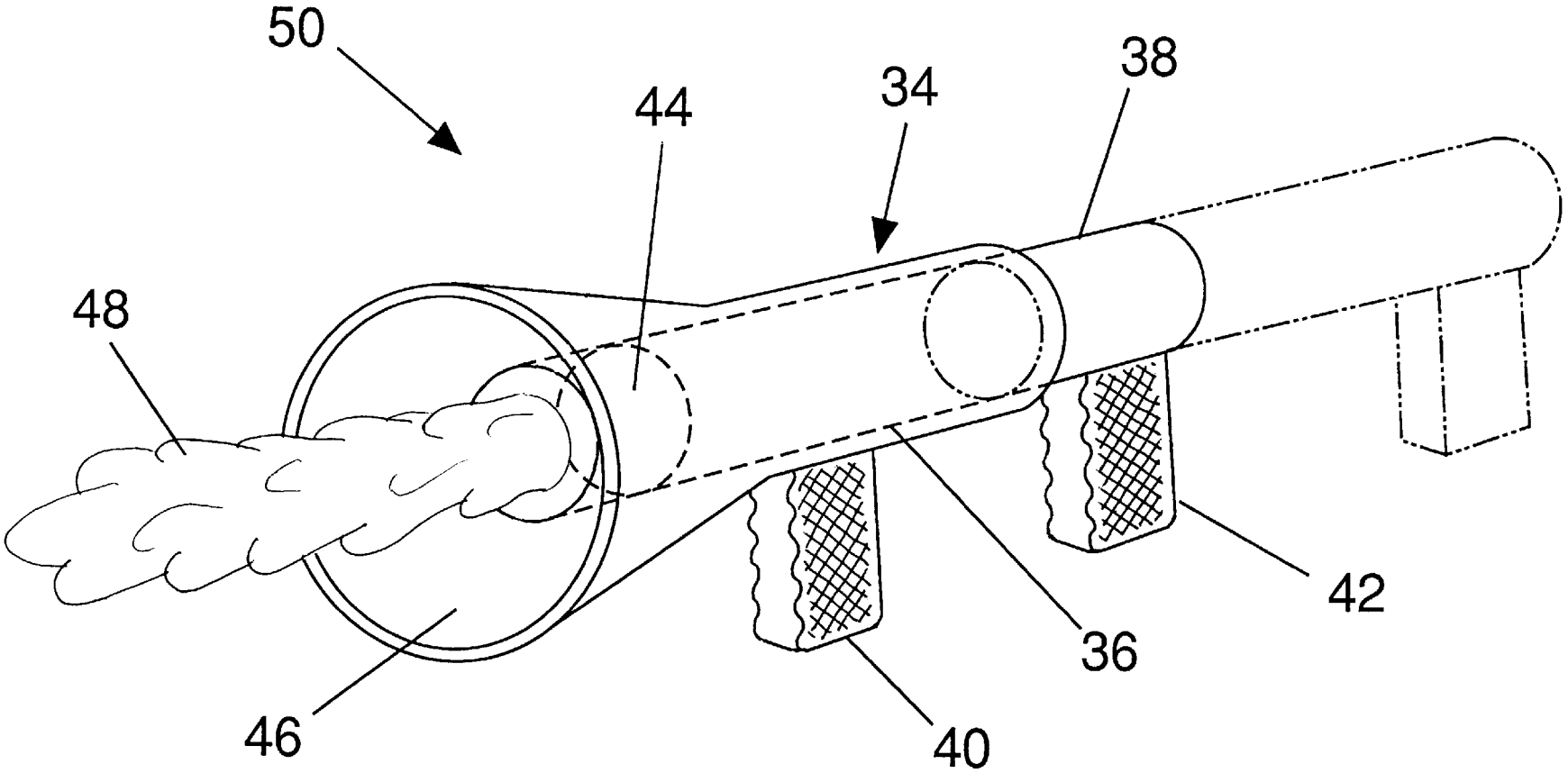
FIG. 2 shows a second embodiment of the water catch game with a push-operated water firing mechanism.

FIG. 2 shows a second embodiment of the water pistol 50 for playing the water catch game with a push-operated water firing mechanism 34. In this embodiment, the water firing mechanism 34 has a cylindrical water reservoir 36 which contains a reciprocating piston 38 operated by a pair of handles 40, 42. The mouth 44 of the cylindrical water reservoir 36 has a large funnel-shaped water collecting target 46 connected to it. When the handles 40, 42 of the water pistol 50 are squeezed together, a stream of water 48 is emitted from the mouth 44 of the cylindrical water reservoir 36. When the handles 40, 42 are pulled apart, water which has been caught in the water collecting target 46 can be drawn into the cylindrical water reservoir 36. A reduced orifice or a venturi can be placed at the mouth 44 of the cylindrical water reservoir 36 to velocitize the stream of water 48 as it exits the water pistol.

Figure 3:
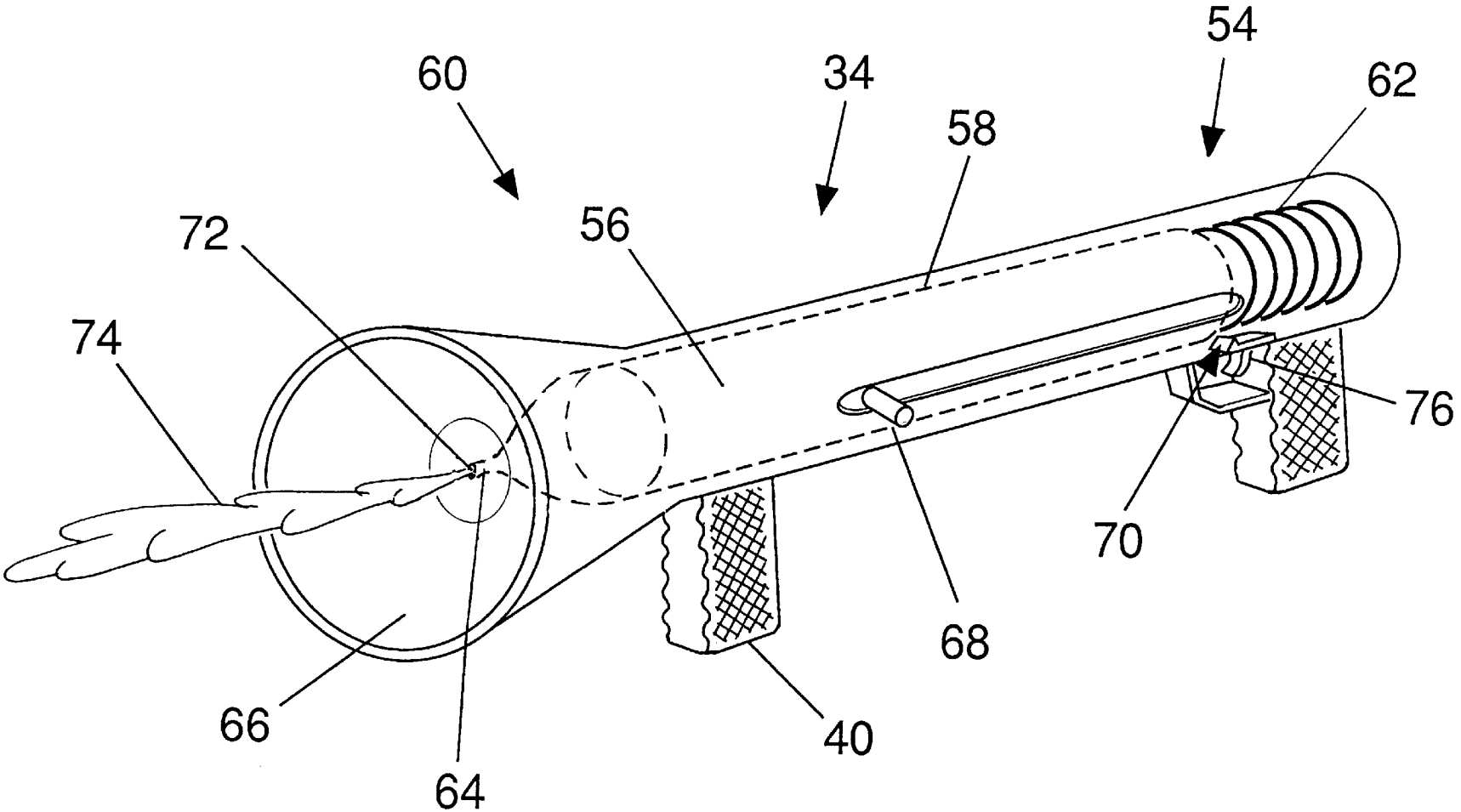
FIG. 3 shows a third embodiment of the water catch game with a spring-operated water firing mechanism.

FIG. 3 shows a third embodiment of the water pistol 60 for playing the water catch game with a spring-operated water firing mechanism 54. In this embodiment, the water firing mechanism 54 has a cylindrical water reservoir 56 which contains a reciprocating piston 58 attached to a spring 62. The mouth 64 of the cylindrical water reservoir 56 has a large funnel-shaped water collecting target 66 connected to it. The firing mechanism 54 is prepared by pulling the piston 58 back with the pull-back lever 68 and compressing the spring 62 until the piston 58 engages the latching hook 70. This draws water which has been caught in the water collecting target 66 into the cylindrical water reservoir 56. When the trigger 76 is pulled, it releases the latching hook 70, allowing the spring 62 to push the piston 58 forward, emitting a stream of water 74 is emitted from the mouth 64 of the cylindrical water reservoir 56. A reduced orifice or a venturi 72 can be placed at the mouth 64 of the cylindrical water reservoir 56 to velocitize the stream of water 74 as it exits the water pistol 60.

Figure 4:
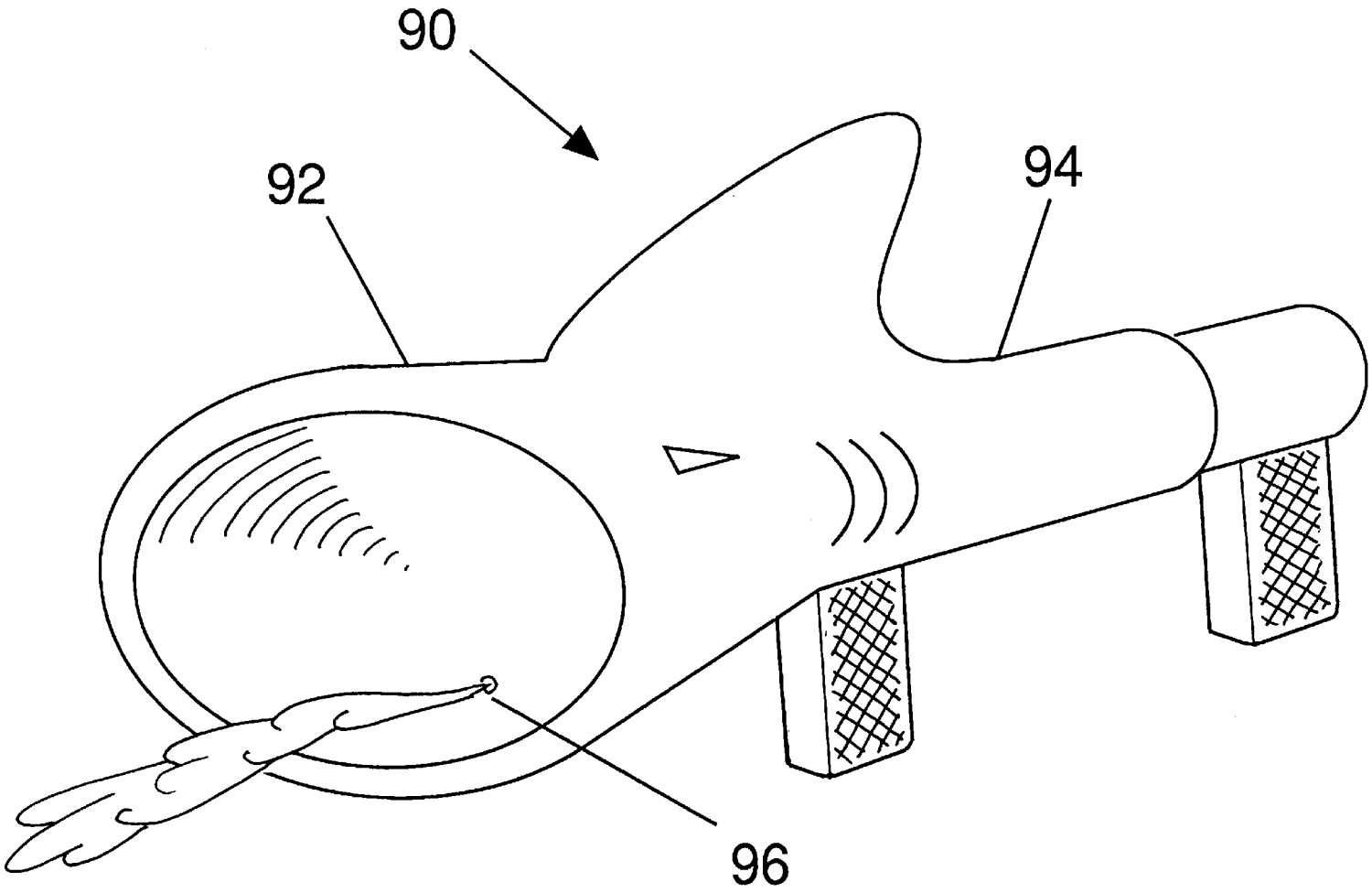
FIG. 4 shows an embodiment of the water catch game with an animal motif.
Figure 5A:
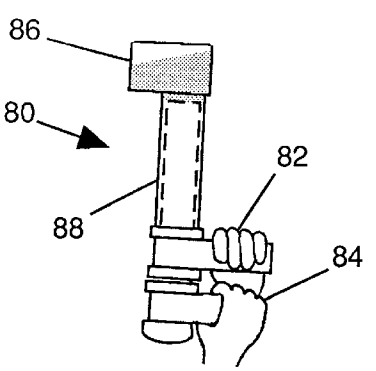
FIGS. 5 A–F show a method of playing the water catch game.
Figure 5B:
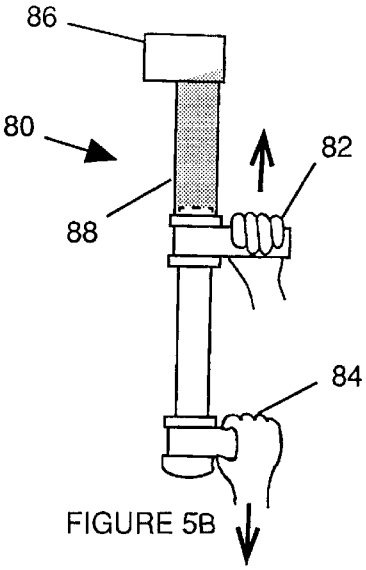
Figure 5C:
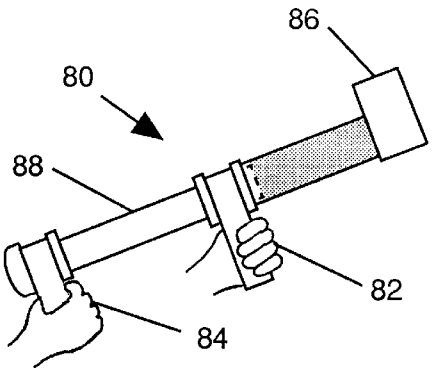
Figure 5D:
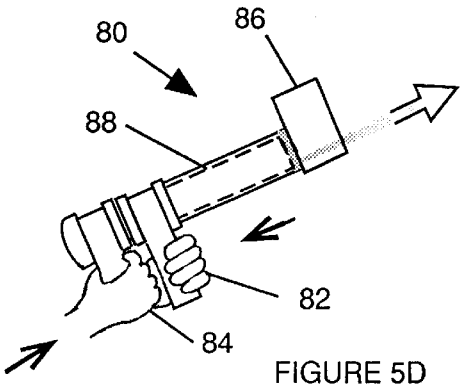
Figure 5E:
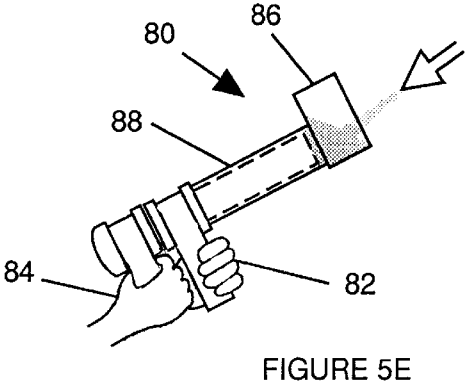
Figure 5F:
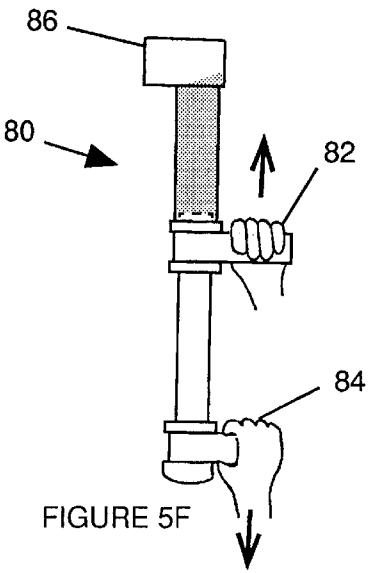

The water pistol for playing the water catch game can also be made with an animal motif. Such an embodiment may be preferable to one that looks like a pistol for children or parents who want to avoid any symbolic associations with real war and violence. FIG. 4 shows an embodiment of the water catch game where the water pistol 90 is made in the shape of a shark. The water-catching target 92 is made in the shape of the shark's mouth and the cylindrical barrel 94 of the water pistol 90 connects to a water-emitting orifice 96 inside the mouth of the shark. Many other motifs can be used for the water pistol and the water-catching target, including other animal motifs, sporting motifs, people, plants, cartoon characters or geometric shapes.

FIGS. 5 A–F show one method for playing the water catch game. The game is recommended for two or more players, although solitary play is possible. The players should face each other ten to thirty feet apart. FIGS. 5 A–F show a water catch game played with a push-operated water pistol 80, similar to the water pistol shown in FIG. 2. With the handles 82, 84 in the closed position, and the gun held upright, Player #1 fills up the water catch funnel 86 with water (FIG. 5A). Then, he or she pulls the handles 82, 84 apart to draw the water into the gun barrel 88 (FIG. 5B). Player #1 aims at the target of player #2 (FIG. 5C) and pushes the rear handle 84 to the closed position (FIG. 5D). This will shoot a long stream of water over to player #2. With his or her handles 82, 84 in the closed position (FIG. 5E) player #2 points the barrel 88 of the water catch pistol at the incoming stream of water and tries to catch as much of the water as possible in the catch funnel 86. After all the water has been shot from player #1, player #2 pulls apart the handles 82, 84 to draw the water into the gun barrel 88, as in FIG. 5A, to begin the cycle again. Steps 5 A–F are repeated until no water is caught by a receiving player. As water is shot and caught, players keep count of the number of times water is caught and try to improve that number each time. Improving the players' score requires skill, coordination and teamwork and cooperation between the players.

There are many possible variations on the basic water catch game, for example:

A game with multiple players, trying to maximize the total number of tosses and catches.

A timed game where the goal is to have the highest number of successful catches in a limited time period.

Continuous squirting from one player to another (FIG. 1). The winner is the one who successfully unloads his reservoir while the opponent still has water in his or her gun.

One-person play, shooting water straight into the air and catching it.

Going for distance. Pairs of players shoot the water back and forth. The players back up one step each shot. The winners are the pair with the longest successful toss and catch.

Hot potato water catch game. Timed or random game, when a signal sounds, whoever is holding the water is "out". Missing a catch or throw could make someone "out" early.

Although the examples given include many specificities, they are intended as illustrative of only some of the possible embodiments of the invention. Other embodiments and modifications will, no doubt, occur to those skilled in the art. For instance, the present invention can be made in the form of a water rifle or cannon or in another form that does not resemble a weapon, or the firing mechanism of the gun can be motorized or pressurized for automatic operation. Thus, the examples given should only be interpreted as illustrations of some of the preferred embodiments of the invention, and the full scope of the invention should be determined by the appended claims and their legal equivalents.

I claim:

1. A water toy, comprising:

a portable, unitary body, comprising:

a target having a water collection opening having a funnel portion, said target configured to receive and collect a stream of water projected from a source independent of said unitary body of said water toy, and a water projection mechanism, wherein a user may intercept and capture the stream of water with said target and then eject the collected water as a new stream of water using said water projection mechanism.

2. The water toy of claim 1 further comprising a water reservoir connected to said water collection opening.

3. The water toy of claim 2 wherein water enters said water reservoir through said water collection opening.

4. The water toy of claim 1 wherein said water projection mechanism projects a stream of water out through said water collection opening.

5. The water toy of claim 1 wherein said water projection mechanism projects water from said water toy proximate an end thereof and said water collection opening is located on said water toy adjacent said end.

6. The water toy of claim 1 wherein said water collection opening is adjacent said water projection mechanism.

7. The water toy of claim 1 wherein said water projection mechanism projects water outside said water toy.

8. The water toy of claim 1 wherein said water projection mechanism comprises a barrel and a reciprocating piston within said barrel.

9. The water toy of claim 8 wherein said water projection mechanism further comprises a first handle attached to said barrel and a second handle attached to said reciprocating piston and said water projection mechanism is operated by moving said second handle relative to said first handle.

10. The water toy of claim 8 wherein said water projection mechanism further comprises a spring which bears against said reciprocating piston and a means for moving said reciprocating piston so as to compress said spring.

11. The water toy of claim 10 further comprising a latching means for holding said spring in a compressed state and a releasing means for releasing said latching means.

12. The water toy of claim 1 wherein said water toy is made in the shape of an animal or character.

13. The water toy of claim 1 wherein said water collection opening is made in the shape of an animal or character.

14. The water toy of claim 1 wherein, when said water projection mechanism is actuated, essentially all of the water within said water toy is ejected.

15. A multi-person water catch game, comprising:

a first portable, unitary-body, water projection device comprising:

a target having a water collection opening having a funnel portion, said target configured to receive and collect a stream of water projected from a source independent of said unitary body of said water toy, and a water projection mechanism;

a second portable, unitary-body, water projection device comprising:

a target having a water collection opening having a funnel portion, said target configured to receive and collect a stream of water projected from a source independent of said unitary body of said water toy, and a water projection mechanism;

wherein said first water collection opening is configured to allow a first user to catch a stream of water from said second water projection mechanism, and wherein said second water collection opening is configured to allow a second user to catch a stream of water from said first water projection mechanism, thereby allowing two user's to alternately catch and project a stream of water.

16. A water pistol for playing a water catch game, said pistol comprising:

a water firing mechanism, a pistol barrel, a trigger for activating said water firing mechanism, and a large scoop-shaped target molded integrally with said pistol barrel of said water pistol, said large scoop-shaped target configured to receive and collect a stream of water projected from a source independent of said water pistol, wherein each time said trigger is depressed, said water pistol emits a stream of water from said pistol barrel, and wherein said scoop-shaped target is connected to said firing mechanism so that water gathered by said scoop-shaped target is available to be squirted out by said water firing mechanism.

17. The pair of water pistols of claim 16 wherein said scoop-shaped target is connected directly to said water firing mechanism.

18. A water pistol for playing a water catch game, comprising:

a push-operate water firing mechanism, comprising:

a water reservoir, and a reciprocating piston contained within said water reservoir;

a pair of handles forming a trigger for activating said water firing mechanism;

a pistol barrel;

and a large scoop-shaped target molded integrally with said pistol barrel and connected to said water reservoir, said large scoop-shaped target configured to receive and collect a stream of water projected from a source independent of said water pistol;

wherein said handles have a first position and a second position, in said first position said firing mechanism is primed, wherein when said handles are moved from said first position to said second position, said water pistol emits a stream of water from said pistol barrel, and wherein said scoop-shaped target is connected to said firing mechanism so that water gathered by said scoop-shaped target is available to be squirted out by said firing mechanism.

19. The water pistol of claim 18 wherein, when in said first position, said handles are spaced apart, and when in said second position, said handles have been drawn together.

20. The water pistol of claim 18 wherein when said water firing mechanism is actuated essentially all of the water in the water reservoir is emitted from said pistol barrel.

21. The water pistol of claim 18 further comprising a reduced orifice located within the water reservoir, thereby velocitizing a stream of water when said water firing mechanism is actuated.

22. A water pistol for playing a water catch game, comprising:

a spring-operated water firing mechanism, comprising:

a water reservoir, a spring, a reciprocating piston located within said water reservoir and attached to said spring, a pull-back lever attached to said reciprocating piston, a latching hook releasably engaging said reciprocating piston, a trigger actuating said latching hook;

a large funnel-shaped water collecting target connected to said water reservoir, said large funnel-shaped water collection target configured to receive and collect a stream of water projected from a source independent of said water pistol;

wherein said firing mechanism is prepared by pulling said reciprocating piston back with said pull-back lever, thereby compressing said spring until said reciprocating piston engages said latching hook, thereby draw water from said water collecting target into said water reservoir, and wherein when said trigger is pulled, said latching hook releases said reciprocating piston allowing said spring to push said reciprocating piston forward, thereby ejecting a stream of water from said water reservoir.

23. The water pistol of claim 22 further comprising a reduced orifice located at a mouth of said water reservoir thereby velocitizing the stream of water.

24. The water pistol of claim 22 wherein said water pistol is made with an animal motif.

* * * * *